United States Patent [19]

Meier

[11] 4,128,077

[45] Dec. 5, 1978

[54] APPLICATION AND DOSING DEVICE HAVING A MINI APPLICATION ROLLER AND A SEALINGLY SUPPORTED DOCTOR ROD

[75] Inventor: Paul Meier, Winkel, Switzerland

[73] Assignee: Bachofen & Meier, Bulach, Switzerland

[21] Appl. No.: 821,001

[22] Filed: Aug. 1, 1977

[30] Foreign Application Priority Data

Aug. 5, 1976 [CH] Switzerland ..... 10044/76

[51] Int. Cl.[2] ..... B05C 11/02

[52] U.S. Cl. ..... 118/104; 118/118; 118/202

[58] Field of Search ..... 118/104, 262, 261, 102; 427/359-366; 15/256.5, 256.6

[56] References Cited

U.S. PATENT DOCUMENTS

| | | | |
|---|---|---|---|
| 2,861,541 | 11/1958 | Hornbostel | 118/104 X |
| 3,031,872 | 5/1962 | Kusters | 427/359 X |
| 3,143,438 | 8/1964 | Campbell | 118/104 |
| 3,179,083 | 4/1965 | Warner | 118/104 |
| 3,387,585 | 6/1968 | Farrell | 118/104 |
| 3,701,335 | 10/1972 | Barnscheidt | 118/104 |
| 3,941,897 | 3/1976 | Vecchia | 427/428 X |

*Primary Examiner*—Morris Kaplan

*Attorney, Agent, or Firm*—Pollock, Vande Sande and Priddy

[57] ABSTRACT

An application and dosing device, especially for the distribution of a highly fluid medium on a sheet of material to be refined, e.g. paper, cardboard, plastics, metal, textiles, etc., includes an application roller and a doctor rod disposed adjacent to the roller. The application roller is in the form of a mini-roller. The doctor rod is supported for rotation in a clamp bearing which partly embraces the lower part of the rod between two spaced viscoelastic bearing members enclosing a wash water channel below the doctor rod. One bearing member is movable and is abutted by an adjustable pressure element urging the movable bearing member towards the other bearing member so as to adjustably hold and seal the doctor rod.

1 Claim, 3 Drawing Figures

APPLICATION AND DOSING DEVICE HAVING A MINI APPLICATION ROLLER AND A SEALINGLY SUPPORTED DOCTOR ROD

The present invention refers to an application and dosing device used in particular for the distribution of a highly fluid medium on a sheet of material to be refined consisting of paper, cardboard, plastic, metal, textiles etc. The application and dosing device according to this invention distinguishes itself from known designs of this type by utilizing a mini-roller being provided as the application roller, and by supporting the doctor rod for rotation in a clamp bearing which partly embraces the lower side of said rod and which comprises two spaced bearing sections fabricated of a visco-elastic material which, in addition to supporting the rod, define a channel therebetween for wash water underneath the doctor rod. One of the bearing sections is movable toward the other and is in operational contact with an adjustable pressure element which flexibly presses the movable bearing section toward the rigid bearing section, thereby supporting the doctor rod for rotation and, at the same time, providing a seal between the doctor rod and the said wash water channel and causing an automatic adjustment which maintains said supporting and sealing functions in the event of a wear of the clamp bearing.

BRIEF DESCRIPTION OF THE DRAWINGS

An embodiment of the invention is represented in the drawings of which.

Figure 2:
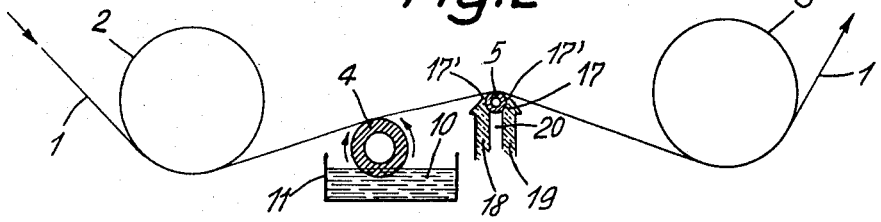
FIG. 2 shows a section through the device.
Figure 1:
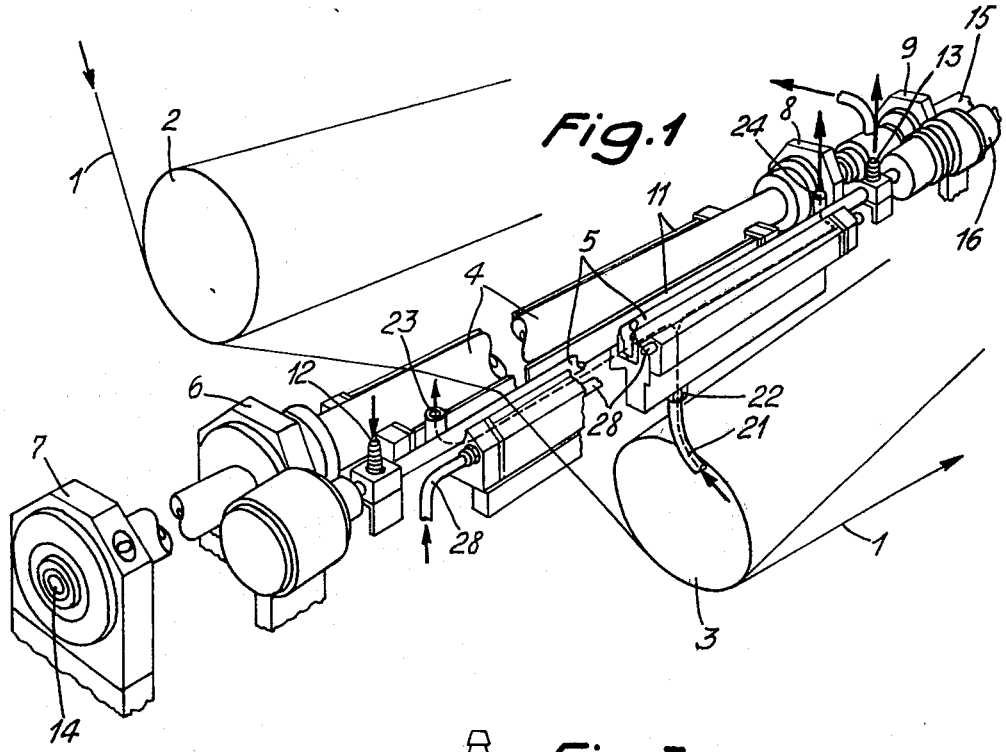
FIG. 1 shows a perspective view of the device.

DESCRIPTION OF THE PREFERRED EMBODIMENT 1 is the sheet of material which is guided and driven through the conveying rollers 2 and 3. Between the two conveying rollers 2 and 3 are the application roller 4 designed as a mini roller and the doctor rod 5 over which the sheet of material 1 passes. Mini roller means a roller having a diameter of less than 60 mm. One end of the application roller 4 is supported in a double bearing 6, 7 and the other end in a double bearing 8, 9. These double bearings give the application roller 4 a high stability and pretension against bending in its center part. The application roller 4 dips into the highly fluid coating medium 10 which is contained in a chute-like trough 11. The application roller 4 can be driven in one or the other direction of rotation so that the coating medium is applied by it onto the sheet of material 1 with the movement of the sheet or against its movement. The sheet contact with the application roller 4 or the doctor rod 5 respectively can be controlled by means of the two conveying rollers 2 and 3 which are arranged at the entry and exit end and are adjustable in a vertical direction. By adjusting the conveying roller 2 in the upward direction, the sheet of material 1 is lifted off the application roller 4 so that no application can take place. Cooling water is passed through the pipe-like doctor rod 5, this water being fed in through the nipple 12 and evacuated through nipple 13. Cooling water is also passed through the application roller 4 which is also designed as a pipe, this water being fed in at one end by means of a pipe connection 14 and evacuated at the other end by means of an outlet connection 15. When the machine is started, the doctor rod 5 is driven at 16.

Figure 3:
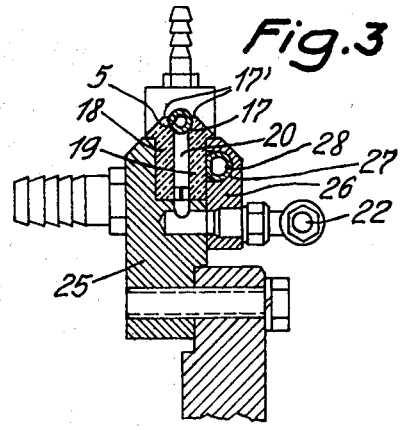
FIG. 3 shows a section through the doctor rod bearing with bearing support.

The doctor rod 5 being arranged at a distance behind the application roller 4 and extending parallel to it, is rotatably supported along its whole length in a positively fitting bed of a clamp bearing 17. The clamp bearing comprises two ledge-like bearing sections 18, 19 acting as jaws, which consist of a viscoelastic plastic, e.g. of a nylon type such as Sustamid or Polyester resin. Between the two bearing sections 18 and 19 is an axial channel 20 for the passing through of wash water which is fed in through the nipple 22 by means of a connecting hose 21 and drained through the two nipples 23 and 24. The rotating doctor rod 5 is continuously cleaned along its bottom side by the wash water passing through the axial channel 20. The surface of the continuously rotating doctor rod 5 is freed of the coating medium by the cutting-edge like scraper edges 17′ tapering upwards (FIGS. 2 and 3) of bearing sections 18 and 19.

The bearing sections 18 and 19 are embedded in a bearing support 25 with stop ledge 26. A rubber-elastic air tube 28 which can be tensioned and slackened by compressed air is provided as a pressure cushion in a transverse groove 27 on the inside of the stop ledge 26, this air tube 28 loading the transversely movable bearing section 19 which is acting as a jaw. The doctor rod 5 in the clamp bearing 17 is held in a tight fit by the bearing section 19; at the same time, an automatic adjustment takes place when the clamp bearing 17 is subjected to wear so that a tight fit remains guaranteed.

The device described in particular allows considerably higher sheet pass rates than has been the case with application devices of the previously known types. During trials it was established that one was able to work at a considerably higher running speed when using mini rollers as application rollers, these having a considerably smaller diameter, because in this case the distance between the level of the application medium 10 in the trough 11 and the transfer onto the sheet of material 1 is very short. This also results in the desired effect being achieved, i.e., that an excellent predosing takes place in conjunction with the smaller sheet contact and the adjustable rotational speed of the application roller 4. This results in a more precise operation by the subsequent doctor rod 5. The smaller application quantity required also permits the use of a smaller trough 11 for the application medium 10, and less liquid is in circulation at any given time. The danger of pigments settling or the medium building up is also reduced. Fresh application liquid is practically always available with this smaller quantity.

The diameter of the mini or application roller appropriately lies within the limits of 40 to 60 mm; of course it is dependent on the transverse bending strength in conjunction with the working width. Bending is practically eliminated by double bearings 6, 7 and 8, 9 since the application roller 4 has a certain initial stress in respect of the bending. The application roller 4 can have an embossed or a grooved surface.

The doctor rod 5 effecting the distribution and dosing by spreading the coating medium onto the sheet of material 1, is largely kept free of any coating by scraper edges 17′ on the bed of the clamp bearing 17.

Normally, the mains pressure of the available water system suffices for passing the water through the application roller 4 and the doctor rod 5. In the event it is desired to supply cooled water, or if the mains pressure is not adequate, a pump system can be used for the feed.

A circulation system where the water passes in a closed loop through the application roller 4, the doctor rod 5 and the axial channel 20, is not suitable since the doctor rod 5 dirties the water after a certain amount of usage. It is, therefore, advantageous to drain the water off once it has passed through the axial channel 20, e.g. into a pit where a separation of the solid matter is effected. In certain cases, e.g. if the doctor rod 5 is very dirty and difficult to clean, the water is circulated under pressure in the axial channel 20. Conventional cleaning products can, of course, be added to the wash water.

The mini roller 4 with its small diameter permits the use of a smaller trough 11 of correspondingly lower capacity and correspondingly smaller depth of immersion of the application roller so that a better revolution of the coating medium is possible.

Of particular advantage is the support of the doctor rods along its whole length in a tightly fitting bed of a clamp bearing consisting of a viscoelastic plastic with good antifriction properties.

The mini roller 4 with its smaller diameter also has the advantage of the medium to be applied having to cover a very small distance from the level of the thin medium in the trough 11 to the sheet of material 1. Surface stresses can, therefore, not have a negative affect in as far as there are no accumulations possible on the roller surface and this results in an even application, particularly in continuous operation. Another result is an improvement in film division after the point of contact with the sheet of material. The reason for the angle becoming considerably more obtuse during runoff is due to the smaller roller diameter. This more distinct film division in turn results in better application conditions. With the film division, the division of the medium takes place as the coating of the sheet of material on one hand and the residue on the rotating application roller on the other hand. The same conditions apply in a reversed sense when working in reverse motion.

Seen overall, the mini roller as an application roller offers substantial advantages in practical use.

I claim:

1. In an application and dosing device for the distribution of a highly fluid medium onto a sheet of material, said device being of the kind including an application roller, and a doctor rod disposed adjacent to said application roller, the improvement wherein the application roller is in the form of a mini roller having a diameter less than 60 mm, the application roller having an axial channel therethrough for passage of cooling water, the doctor rod being supported for rotation in a bearing which partly embraces the lower side of said rod, said bearing comprising a bearing support which supports two spaced bearing members fabricated of a viscoelastic material, the doctor rod being sealingly engaged by and supported under resilient clamping pressure between said bearing members along substantially the entire length of said doctor rod, said bearing members having scraper edges adjacent their upper edges respectively in engagement with spaced portions of the lower side of said rotatable doctor rod, said bearing members having respective portions which extend in generally parallel relation to one another below said doctor rod to define the sides of a wash water channel immediately below the doctor rod, a ledge secured to said bearing support and having a transverse groove therein, an elastic compressed air tube supported in said groove and constituting an adjustable pressure element, one of said bearing members being movable and being abutted by said adjustable pressure element, said pressure element being operative to resiliently urge said one bearing member towards the other bearing member so as to provide adjustment between said bearing members and said doctor rod to maintain said sealing engagement when the bearing becomes worn.

* * * * *